United States Patent [19]

Harwood

[11] Patent Number: 4,790,909

[45] Date of Patent: Dec. 13, 1988

[54] TWO-WIRE PAPER FORMING APPARATUS

[75] Inventor: John W. Harwood, Janesville, Wis.

[73] Assignee: Beloit Corporation, Beloit, Wis.

[21] Appl. No.: 173,006

[22] Filed: Mar. 28, 1988

Related U.S. Application Data

[63] Continuation of Ser. No. 942,731, Dec. 17, 1986, abandoned.

[51] Int. Cl.[4] ..... D21F 1/00

[52] U.S. Cl. ..... 162/301; 162/352

[58] Field of Search ..... 162/300, 301, 303, 348, 162/352, 369, 370, 203

[56] References Cited

U.S. PATENT DOCUMENTS

| | | | |
|---|---|---|---|
| 2,911,039 | 11/1959 | Hornbostel . | |
| 3,150,037 | 9/1964 | Lee . | |
| 3,232,825 | 2/1966 | Robinson . | |
| 3,311,533 | 3/1967 | De Montigny . | |
| 3,403,073 | 9/1968 | Moran . | |
| 3,839,143 | 10/1974 | Suckow . | |
| 3,846,232 | 11/1974 | Kankaanpaa . | |
| 3,846,233 | 11/1974 | Kankaanpaa | 162/348 |
| 3,884,756 | 5/1975 | Gustafson . | |
| 3,944,464 | 3/1976 | Means | 162/301 |
| 3,992,253 | 11/1976 | Schiel . | |
| 3,996,098 | 12/1976 | Kankaanpaa . | |
| 4,028,174 | 6/1977 | Myren | 162/301 |
| 4,100,018 | 7/1978 | Wahren . | |
| 4,125,428 | 11/1978 | Phelps . | |
| 4,557,802 | 12/1985 | Waris | 162/301 |
| 4,609,435 | 12/1985 | Tissari | 162/301 |

FOREIGN PATENT DOCUMENTS

| | | | |
|---|---|---|---|
| 0177439 | 4/1986 | European Pat. Off. . | |
| 3222428 | 12/1983 | Fed. Rep. of Germany | 162/301 |
| 3501312 | 7/1985 | Fed. Rep. of Germany | 162/348 |

OTHER PUBLICATIONS

Pulp & Paper, Sep. 1982, "Twin-Wire Tissue", p. 135.
Pulp & Paper, Sep. 1982 "Papriformer", p. 136.
Pulp & Paper, Sep. 1982 "Speed-Former", pp. 138-139.
Pulp & Paper, Sep. 1982 "Bel-Baie II", p. 135.

*Primary Examiner*—David L. Lacey
*Assistant Examiner*—K. M. Hastings
*Attorney, Agent, or Firm*—Dirk J. Veneman; Raymond W. Campbell; Gerald A. Mathews

[57] ABSTRACT

A two-wire paper forming apparatus wherein the co-running forming wires converge over a forming roll and diverge over a couch roll downstream of the forming roll. A curved forming zone begins where the forming wires converge over the forming roll to receive a stock stream, and extends to before the couch roll whereby the forming roll in conjuction with a pair of convexly curved dewatering shoes disposed against the forming wires between the forming roll and the couch roll form the web while providing improved retention and formation.

9 Claims, 4 Drawing Sheets

TWO-WIRE PAPER FORMING APPARATUS

This is a continuation of co-pending application Ser. No. 942,731, filed on Dec. 17, 1986, now abandoned.

BACKGROUND OF THE INVENTION

This invention relates to two-wire papermaking apparatus. More particularly, it relates to two-wire paper forming apparatus especially designed to form so-called lightweight coated grades of paper (i.e. lightweight coating rawstock or coating rawstock) at high speeds such as, for example, 3,500 feet per minute or greater. Still more particularly, this invention relates to two-wire paper forming apparatus wherein the forming wires define a curved forming zone.

Presently, lightweight coated grades of paper (LWC) are made on papermaking machine which utilize a fourdrinier forming zone. While the fourdrinier arrangement can produce this grade paper at relatively high speeds—such as, for example, about 3,000 feet per minute, the single fourdrinier forming wire inherently produces what is known in the trade as a two-sided sheet. In other words, the sheet has different surface properties and appearance, such as wire marks and different proportions of fines and fillers on either side of the sheet. LWC grades, which generally range from about 30–48 grams/m$^2$, are commonly used for magazine paper, and the demand for such paper has increased markedly in the past few years as has the requirement that both sides of the sheet have equal coating and printability properties. This means that the paper web be as close to one-sided as possible. This one-sided characteristic simply cannot be produced on fourdrinier machines because the water drainage during the formation process is in one direction only so the resulting distribution of fines, fibers and fillers is not equal on both sides of the web. Further, the wire marks only the bottom side of the web which exacerbates the differences, or two-sided nature of paper webs formed on fourdrinier type machines.

In addition, other two-wire paper forming machines also are deficient in their suitability for forming LWC paper grades due to their arrangement of the various elements which contribute to the manner in which water is urged from the stock, the duration of this water removal process, the sequence of the application of the water removal elements to either side of the forming zone and the shape of the forming zone itself.

Thus, in prior two-wire forming arrangements, an excessive proportion of the fines and fillers, which greatly contribute to the overall quality of a coated paper sheet, were removed initially in the paper forming process. Once removed, they could not be subsequently replaced in the web as it is formed, nor could their absence be entirely compensated for by other means, such as applying excess coating.

However, if it is attempted to retain the fines and fillers in the paper web by not subjecting it to strong water removal forces during its initial stages of formation, the web cannot be produced at an economically competitive speed.

SUMMARY OF THE INVENTION

This invention obviates the problems associated with producing LWC grades of paper having as close to one-sided surface properties as possible. In this invention, the two forming wires converge with a quantity of stock therebetween. This sandwich of pulp stock between the forming wires then travels over a foraminous forming roll where some water is removed inwardly through the second forming wire on the forming roll and some water is removed outwardly by centrifugal force through the first forming wire. In this manner, the critical initial formation of each side of the paper web is closely controlled and sustained over the forming roll and made very close to equal regarding the amount and rate of dewatering through both forming wires.

During the subsequent web forming process, the path of travel describes a gentle undulating, or reversing, curve from the point where the forming wires converge over the forming roll to a point downstream of the last forming element operating in conjunction with either of the forming wires. The shape of the forming wires' path of travel, and the forming zone, is thus defined by the periphery of the forming roll over which the co-running forming wires pass and the subsequent curved paths over the forming elements. The curved path is alternately concave toward the center of one looped forming wire and then concave toward the center of the other looped forming wire, hence the "reversing" characteristic. In between the ends of the S-shaped formation path, the web is subjected to vacuum pressures on either, or both, sides in varying degrees by application of either foil blades to the undersides of the forming wires or perforated cover boxes having a source of vacuum applied thereto to urge water through the forming wire and into the box. This combination of initial vacuum, curved foil boxes, or perforated cover boxes and deflector blades disposed on the outside of the concavely curved portions of the path of the co-running forming wires provides the desired degree of water removal from both sides of the web during the forming process while permitting the retention of a high proportion of the fines and fillers to produce the desired one-sided web.

Other chronic problems in the production of LWC paper grades, besides two-sidedness, is the elimination of pin holes and controlling wrinkling. Pin holes tend to be a problem in all lightweight paper grades and streaking tends to become a problem in the production of paper on two-wire formers where the unsupported span of the co-running forming wires exceeds about 6 feet. Clearly, the elimination of both pin holes and wrinkling is a very important requirement in the production of magazine paper.

The apparatus of this invention operates to both markedly decrease the incidence of pin holes as well as eliminating streaking which occurs when a portion of the web extending in the machine direction is drained at a different rate than adjacent areas of the web resulting in a "streak" of an uneven, generally larger, caliper of web that is wound at the reel. This is accomplished by the gentle, S-shaped curvature of the path of the forming wires in the formation zone in combination with the close, intermittent support of the wires by the shoes guiding the forming wires and the initial, gentle dewatering over the forming roll.

The combination of initial drainage over the forming roll, where the stock is subjected to relatively constant pressure for a period of time, and the subsequent drainage over the shoes, where the stock is subjected to the pulsing pressures of the foil blades, produces a desired sequence and type of dewatering action to achieve a drainage profile which retains fines and fillers in the surfaces of the web while providing good formation of the fibers in the web.

Accordingly, it is an object of this invention to provide two-wire paper forming apparatus which controls two-sidedness, particularly in the production of LWC paper grades.

Another object of this invention is to provide two-wire paper forming apparatus which leaves substantially equal amounts of fillers on either side of the paper web.

Another object of this invention is to provide a two-wire paper forming apparatus which produces little, or no, streaking in the paper web produced.

Still another object of the invention is to provide a two-wire paper forming apparatus which provides initial dewatering over a forming roll and subsequent dewatering along an undulating, or reversing, curved forming zone.

A feature of this invention is the provision of a uniquely curved two-wire forming zone.

An advantage of this invention is the capability o producing high-quality LWC grades of paper at high speeds.

These and other objects, features and advantages of the invention will be readily discerned by those skilled in the art upon reading the description of the preferred embodiments in conjunction with the attached drawings.

DESCRIPTION OF THE PREFERRED EMBODIMENTS

Figure 1:
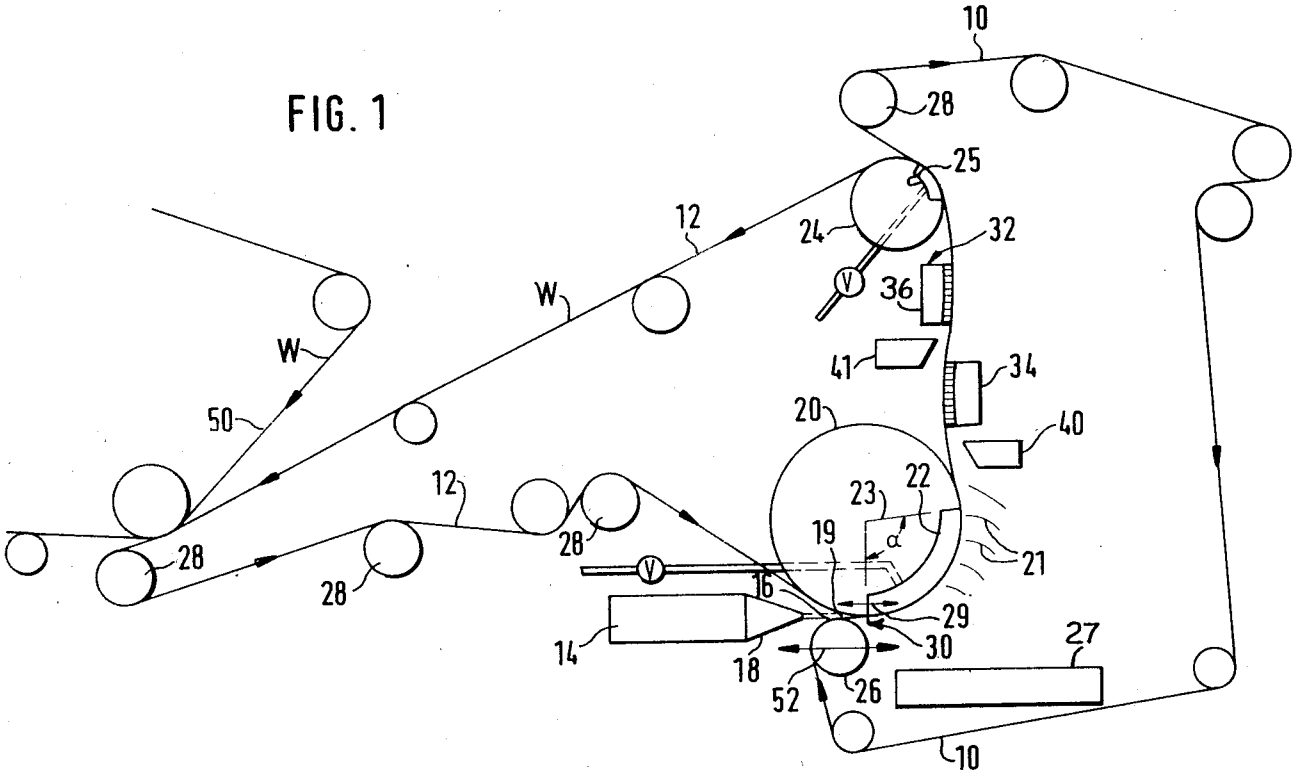
FIG. 1 is a side-elevational view which illustrates the preferred embodiment of the forming zone of this invention in generally schematic form.

In FIG. 1, a headbox 14 is positioned with its nozzle 18 aimed substantially horizontally to direct its stock jet 16 onto the first endless forming wire 10 as it passes over lead-in guide roll 26 and travels for a short distance substantially horizontally. A second endless forming wire 12 is looped about the surface of a forming roll 20 so that the first and second forming wires come into their initial co-running path of travel together near the lowermost point on the peripheral surface of the forming roll 20. This forming roll has a relatively large diameter (i.e. about 60 inches), and is open-faced (i.e. having an outer surface which is foraminous, such as having a large number of holes drilled therein, or having its surface formed with a plurality of interstices or slots covered by a fine mesh wire), or is water pervious for the purpose of permitting water drained from the stock to travel inwardly to the interior of the roll for removal along the roll's axis. In the preferred embodiment, a suction box 22 is positioned inside forming roll 20 with the beginning of its suction gland beneath the point where the first and second forming wires 10,12 come together tangentially against its surface. This suction box 22 then extends downstream for an angular distance, such as up to about 90–100 degrees, at which point the first and second co-running forming wires diverge from the forming roll to travel further downstream in the forming zone.

Positioned over the surface of forming roll 20, within the first forming wire 10, are a plurality of deflector foils 21. These deflector foils are arcuately disposed adjacent the inner surface of the first forming wire to receive water being urged therethrough and centrifugally flung from the underside of the wire. This water is then collected in a saveall 27 for removal from the open ends of the looped first forming wire.

Figure 7:
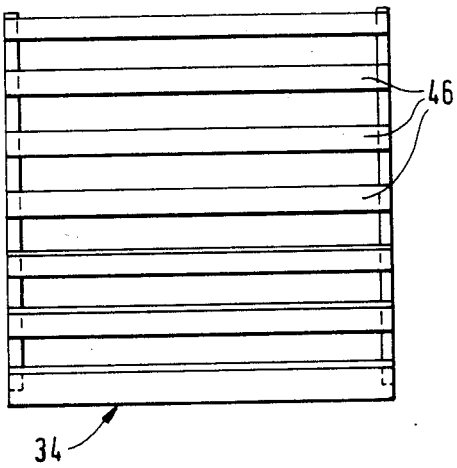
FIGS. 7 and 7*a* are front and side views, respectively, of the foil box configuration of the dewatering shoes shown in FIGS. 1–3.
Figure 7A:
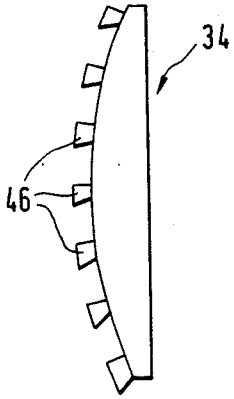
Figure 8:
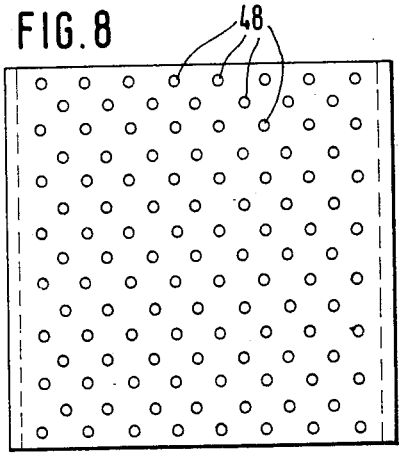
FIGS. 8 and 8*a* are front and side views, respectively, of the perforated cover configuration of the dewatering shoes shown in FIGS. 1–3.
Figure 8A:
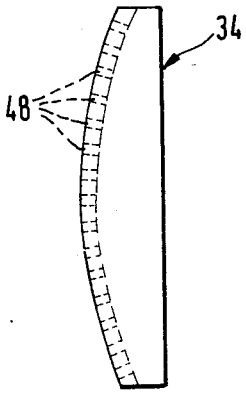

A short distance downstream of the generally vertically co-running first and second forming wires, a first dewatering shoe 34 is mounted within the first forming wire 10 to contact, deflect and guide the co-running forming wires over its foraminous surface. In the preferred embodiment, this first dewatering shoe surface is curved in a concave direction toward the inside (or convexly curved outwardly) of the first forming wire and is pressed into the wires to urge them outwardly in a curved path to urge water inwardly into the shoe by their tension. The surface of the first dewatering shoe is foraminous, or open, to permit water expressed through the inside of the first forming wire to be collected within the box for eventual removal. The configuration of the surface can take several forms. The two preferred forms define the open area by either mounting a plurality of foil blades 46 (most preferred) parallel in the cross-machine direction to define the desired curve, or radius, in the downstream direction, such as shown in FIGS. 7 and 7*a*, or by drilling a plurality of closely-spaced holes 48 through a curved surface, such as shown in FIGS. 8 and 8*a*.

Still referring to FIG. 1, the co-running forming wires 10,12 continue travelling upwardly where they come onto the surface of a second dewatering shoe 36. This second dewatering shoe is, in the preferred embodiment, similar to the first dewatering shoe and is concave toward the inside (or convexly curved outwardly) of the second looped forming wire. This second dewatering shoe is disposed within the second forming wire to urge the co-running forming wires outwardly over its curved surface to create a desired amount of wire tension and to promote passage of water through the second wire and into the second dewatering shoe. The second dewatering shoe 36 can have its curved, foraminous surface formed of any of the configurations used on the first dewatering shoe surface, such as by foil blades or a perforated cover.

In the preferred embodiment, first and second dewatering shoes 34, 36 are convexly curved toward the forming wires and are connected to vacuum sources 42, 44, respectively, to urge water into them through the forming wires. However, these shoes, particularly, in their foil surface configuration, may be used without externally applied sources of vacuum. In this case, savealls 40, 41 would be used in conjunction with them to collect and remove the water from them.

As the co-running forming wires 10, 12 travel beyond the second dewatering shoe 36, they come onto, and are turned over, the surface of couch roll 24 which has a suction box 25 therein which urges the wet web to remain on the surface of the second forming wire 12 as the first forming wire 10 is directed away, and over, the nearby guide roll 28. The looped first forming wire then travels over a plurality of other guide rolls 28 to return to the lead-in guide roll 26 where it begins the web formation process over again.

The web travelling on the surface of the second forming wire 12 continues downwardly to where a pickup felt 50 is brought into contact with the exposed web W where the greater affinity of the web for the felt, compared with the forming wire 12, causes it to be picked off the forming wire 12 and directed into the beginning of the remainder of the papermaking machine where it is pressed, dried, finished and reeled into rolls for eventual sale or further processing, such as being coated.

Just as the foraminous, or open, surface of the first and second dewatering shoes 34,36 can comprise slots, holes, or combinations of both, and can be defined by a plurality of closely-spaced, parallel foil blades, and can be used with or without a source of vacuum to urge water inwardly through the contiguous forming wire with the desired degree of force, it is also anticipated that the first and second dewatering shoes themselves can be positioned in different combinations within the first and second forming wires.

In this regard, by means of a convention to designate the first and second forming shoes regardless of whether they are positioned within the first or second forming wires, the dewatering shoe immediately downstream of the forming roll 20 will be designated the first dewatering shoe and the next dewatering shoe downstream of the first dewatering shoe will be designated the second dewatering shoe regardless of which forming wire they are mounted within.

Also, corresponding elements in the various embodiments shown in FIGS. 2–6, will have the same numerical designation with different letter suffixes to assist in the review of this description.

Figure 2:
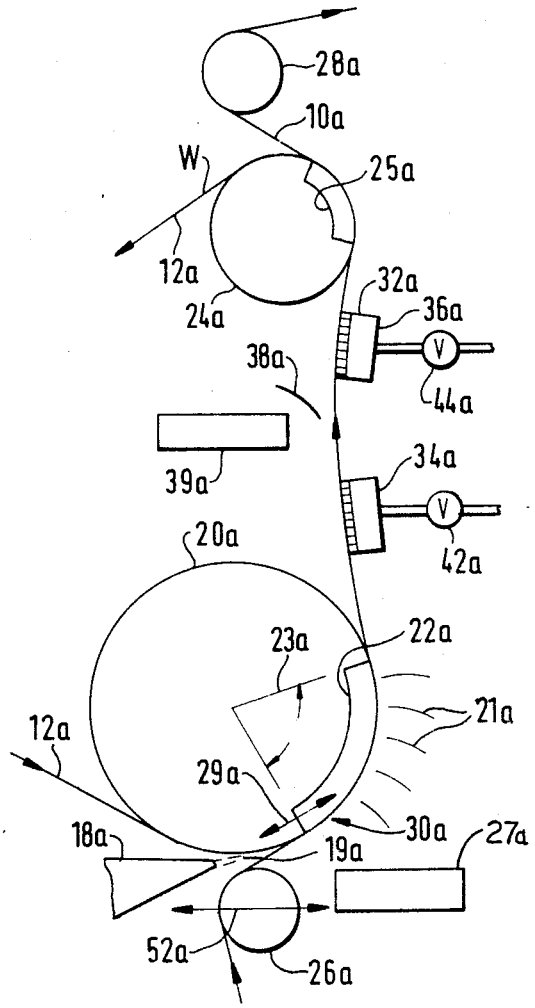
FIG. 2 is a side-elevational view of another embodiment of this invention wherein the first and second forming shoes are disposed within the first forming wire.

Accordingly, referring to FIG. 2, first and second dewatering shoes 34*a*, 36*a* are both disposed within the first forming wire. Both of their surfaces are convex-outward shaped to bow the co-running forming wires in a correspondingly curved path of travel. Since both the first and second dewatering shoes are within the first forming wire, it is expected that a certain amount of water will be expressed outwardly therefrom and inwardly through the inner surface of the second forming wire, so a plurality of deflection foils 38*a* are disposed within, but do not contact, the second forming wire to intercept and direct this centrifugally-expressed water away from the forming zone and into a saveall 41*a* for removal.

In accordance with the principles of this invention, the forming roll forming area 23*a*, which is represented by the included angle $\alpha$ of the forming roll periphery covered by the suction box 22*a*, can be varied by making the front wall of the suction box 22*a* circumferentially adjustable. The lead-in guide roll 26*a* and headbox nozzle 18*a* are then adjusted correspondingly to move the nozzle around the forming roll periphery so as to adjust the amount of water withdrawn from the stock between the wires over the forming roll. This adjustment is done in coordination with the quantity and rate of water removal through the first and second dewatering shoes 34*a* and 36*a* so as to effectively balance the total water removal, and concomitant ash and fines, fiber and filler removal through both the first and second forming wires.

Figure 3:
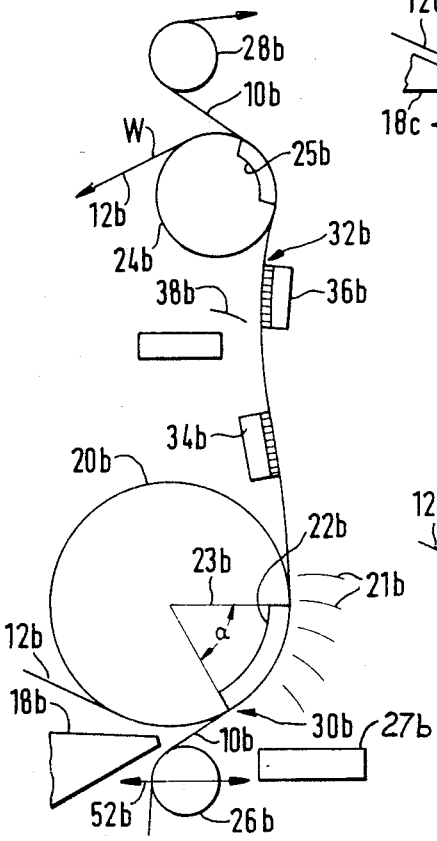
FIG. 3 is a side-elevational view of still another embodiment of this invention wherein the first forming shoe is within the second forming wire and the second forming shoe is within the first forming wire.

In FIG. 3, the first and second dewatering shoes 34*b*, 36*b*, respectively, are again disposed within separate forming wires with the first dewatering shoe mounted within the second forming wire and the second dewatering shoe mounted within the first forming wire. Also, both dewatering shoes have convexly curved surfaces for contacting the inner sides of their respective wires, and these surfaces can, like the dewatering shoes in the other embodiments, be comprised of a plurality of foil blades or a cover having a plurality of holes drilled in its surface. The forming area 23*b* within the forming roll 20*b* can be made much smaller and/or have a much less intense vacuum applied thereto in order to reduce the initial forming roll drainage which changes the roll drainage/foil blade drainage ratio, as desired. Also, in a manner similar to the embodiment shown in FIG. 2 (i.e. noncontacting with the wire), a deflector 38*c* is disposed within the second forming wire opposite the convexly curved wire surface at that point to receive and deflect water flung from the inner surface of the second forming wire by centrifugal force during the forming process.

Figure 4:
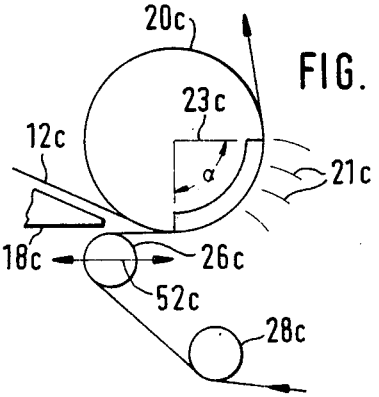
FIG. 4 is a side-elevational view of the forming roll of this invention wherein the headbox nozzle and location of the initial point of contact of the first forming wire over the forming roll have rotated to a point further downstream over the forming roll.

FIG. 4 illustrates how the forming area 23*c* might range up to about 100 degrees from a point at the lowermost periphery of the forming roll 20*c* to the point where the forming wires tangentially leave the surface of the forming roll.

In fioure 5, the forming roll suction box 22*d* is shown divided into partitions 19, 119, 219 and 319 so as to more closely control both the application of vacuum and the extent of the vacuum applied at this point of the web forming process. Thus, as lead-in guide roll 26*e* is adjusted in the direction of the double-headed arrow 52*e*, one or more of the vacuum chambers 19, 119, 219 and 319 can be eliminated, diminished or increased, as desired.

Figure 6:
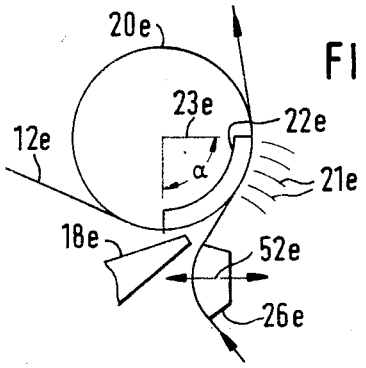
FIG. 6 is a side-elevational view of the forming roll wherein the first forming wire is guided onto the forming roll by a non-rotating guide.

In the embodiment shown in FIG. 6, the lead-in guide roll has been replaced by a non-rotating shoe 26*e* which, in the preferred embodiment, has a ceramic surface to facilitate the travel of the first wire thereover. In some installations, this type of structure is preferred because it permits more precise control of the deflection of the supporting guide 26*e* and totally eliminates any vibration associated with a rotating roll. This permits a wider range of incoming throat configurations.

In operation, a first forming wire 10 is guided onto a forming roll 20 by traveling over an adjustable lead-in guide roll 26 which is adjustable in the direction of double-headed arrow 52 to change both the shape and location of a throat 19 formed between the first forming wire and a second forming wire 12 which is brought into traveling contact with the forming roll 20 upstream of the first forming wire. The area of convergence of the first and second forming wires adjacent the surface of the forming roll (i.e. preferably when the second forming wire is contacting the forming roll surface, but not necessarily) is known as the throat 9 in which the nozzle 18 of the headbox 14 projects a stock stream into this throat adjacent the forming roll.

In this invention, the term "stock" is used to denote a slurry of water and fibers passing from the headbox to the forming wires. The slurry begins to be dewatered upon passage of water outwardly through either or both of the forming wires and the slurry continues to be dewatered as the concentration of fibers and the degrees of dryness are increased as the stock continues downstream. Thus, the slurry continues to be "stock" as long as fiber orientation and transfer of fiber and fines continues to occur. Eventually, the stock becomes a web W.

Immediately after the throat area, the stock is carried over the forming roll area 23 of the forming roll where it is subjected to gentle vacuum pressure inwardly through the second forming wire and a slight centrifugal force outwardly through the inner side of the first forming wire. The forming roll forming area is substantially defined by an angle $\alpha$ which is subtended by the arcuate distance of a suction box 22 which, in turn, defines on its upstream side, the location where the first and second forming wires come together tangentially thereover and, at its downstream end, where both forming wires tangentially leave the forming roll.

With particular reference to FIGS. 2, 4, 5 and 6, the forming roll forming area can be increased or decreased (i.e. angle $\alpha$ can be increased or decreased) as desired to provide a longer forming area 23 over, for example, a single suction box 22 (FIG. 2), or to provide a shorter forming area over one or more sections 19, 119, 219, 319 of a partitioned suction box (FIG. 5) which may have varying degrees of vacuum pressure applied to the various partitions. In all cases, the forming roll forming area provides gentle, controlled vacuum pressure to remove water inwardly through the second forming wire in order to promote good web formation with adequate retention of ash, fines and other fillers.

Figure 5:
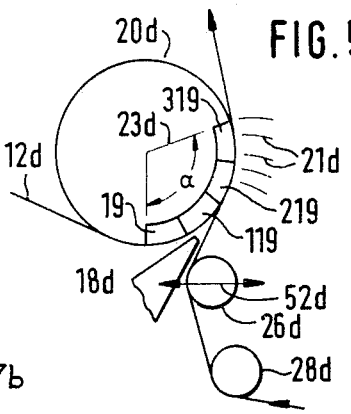
FIG. 5 is a side-elevational view of the forming roll, similar to FIG. 4, wherein the headbox nozzle and location of the point where the first forming wire contacts the forming roll have rotated still further downstream over the surface of the forming roll.

In addition to varying the location of the forming roll forming area 23, the lead-in guide 26, which may be a roll or a stationary curved structure such as a ceramic foil-like surface 26*e* (FIG. 6) is adjustably mounted to move, such as for example, in the direction of double-headed arrow 52, to shift the point where the first forming wire 10 comes into tangential contact with the slurry over the second forming wire over the forming roll 20. This permits the location of the headbox and its nozzle 18 to shift, as desired, circumferentially about the surface of the forming roll as seen in FIGS. 4 and 5. This both changes the residence time the slurry is exposed to the forming roll forming area as well as varies the effects of gravity on the initial dewatering over the forming roll It also changes the amount of drainage occurring around the forming roll.

As the forming wires leave the forming roll with the slurry sandwiched between them, they are directed over a convexly-curved surface of a first dewatering shoe 34 which reverses the curved path of travel of the stock from the curved path it was traveling over the forming roll. The convex-outwardly curved surface of the first dewatering shoe may be defined by a plurality of foil blades having the same blade area contacting the inner side of the forming wire (FIGS. 7, 7*a*), or by a plurality of blades wherein the blade areas contacting the forming wire are different. In addition, the first dewatering shoe may have an arcuate surface which is perforated with holes or slots (FIGS. 8, 8*a*). Similarly, the second dewatering shoe may take either form. Finally, the first dewatering shoe may, as desired, be either connected to a source of vacuum such as pump 42*a* (FIG. 2) or have no vacuum connection at all. In this latter case, a suitable saveall 40, 41 (FIG. 1) is provided to collect and remove the water skimmed from the forming wire by the pumping pressure pulse action of the foils in the first and second dewatering shoes.

As shown in FIG. 2, downstream of the first dewatering shoe, within the second forming wire over the convexly-curved path of forming wire travel, one, or more, deflector foils 38*a* is or are mounted adjacent to, but not in contact with, the inner surface of the second forming wire to receive and deflect the water flung outwardly through the second forming wire by centrifugal force as the forming wires bend away and over the surface of the second dewatering shoe 36*a*. This water centrifugally removed through the second forming wire is then collected by a saveall 39*a*.

As in all configurations, the co-running forming wires travel a convexly-curved path of travel in the span between the forming roll 20 and the couch roll 24. Again, referring to the configuration shown in FIG. 2, the traveling forming wires then come onto a second dewatering shoe 36*a* which can take any of the foil or perforated cover embodiments described previously in connection with the first dewatering shoe 34*a*. Additional water is thus removed from the co-running forming wires through the second dewatering shoe either by the pumping pressure pulse action of the foil blades alone or in conjunction with vacuum pressure provided by a pump 44*a*. This vacuum pump 44*a* may also be connected to the alternate perforated cover configuration. As the forming wires leave the second dewatering shoe, they are guided onto the surface of a couch roll 24 which has a suction box 25 to urge the now substantially-formed web W onto the second forming wire 12 as the first forming wire 10 is guided away from the web and onto the first of a plurality of guide rolls 28 which support it, as well as the second forming wire 12, in their endless loops of travel. The web W continues on the surface of the second forming wire where it is picked off by a pickup felt 50 and carried downstream for further processing.

In all of the embodiments, the forming zone is seen to define a gentle reversing, curved path from the point 30 where the first and second forming wires converge over the forming roll to the point 32 where they leave the second dewatering shoe. During this path of travel, the forming wires are both supported by the surface of the forming roll and the surfaces of the first and second dewatering shoes so that a no time is their path of travel unsupported by more than about a couple of feet.

The embodiments shown in FIGS. 2 and 3 illustrate different configurations of the location of the first and second dewatering shoes 34, 36 within the first and second forming wires. The operation of shoes 34, 36 is the same, but different combinations of cover and foil configurations might be used depending on various operating parameters, such as their position, machine speed and the specific paper grade being manufactured.

In the embodiments shown in FIGS. 1, 2 and 3, the forming zone from point 30 over the forming roll to point 32 before the couch roll takes the form of a gently reversing curve as the co-running forming wires travel over a portion of the forming roll surface and over the two convexly curved dewatering shoes. The stock is thus first exposed to the somewhat low, constant and extended drainage pressure over the surface of the forming roll. This is where retention of the fines and fillers in the stock being formed into a paper web occurs.

Next, the co-running forming wires travel over the first dewatering shoe where the stock is most preferably exposed to the somewhat higher, fluctuating and rapid pressure pulses provided by a set of foil blades. This is where formation of the fibers into a paper web occurs.

Finally, the co-running forming wires travel over the second dewatering shoe which is also most preferably comprised of a set of foil blades. This produces an additional degree of fiber formation as the direction of wire curvature is reversed.

Thus, the low, constant and extended drainage pressure over the forming roll disrupts the individual fiber placement to a lesser extent in the formation process while enhancing retention of fines and fillers. About 30%–40% of the free water is removed from the stock over the forming roll.

Over the dewatering shoes, the drainage rate is intensified to promote fiber formation. Approximately 60%–70% of the free water is removed from the stock At this point, a greater proportion of fines and fillers are likely to be retained since there is less water to carry them out of the web.

This initial passage of the stock over the relatively low, constant and extended pressure area of the forming roll in conjunction with the relatively high, fluctuating and brief pressure pulses over the dewatering shoes thus provides a unique pressure profile. This promotes water removal while enhancing filler retention and fiber formation in the web being formed to achieve the objective of producing a one-sided, high quality LWC paper sheet.

While all of the embodiments in FIGS. 1–4 are shown in a substantially vertical array, it is understood that the whole former, including the apparatus between the forming roll 20 and couch roll 24, can be rotated as a unit to assume any position between vertical and substantially horizontal, as desired, while maintaining the gently curved forming zone between points 30 and 32. Similarly, various other modifications and adjustments of the apparatus can be made without departing from the spirit and scope of the invention as claimed.

What is claimed is:

1. In a two-wire apparatus for forming a paper web, including first and second looped forming wires arranged to travel together in opposed array along a common path during a portion of their length, and a headbox for projecting a stream of stock into a throat formed by the forming wires, the improvement comprising:

a forming roll disposed within the second looped forming wire, the forming roll having an internal suction box and a foraminous surface for admitting water form the stock through the second forming wire;

a forming area on the forming roll surface over the suction box for receiving water urged through the foraminous surface and into the suction box;

the second forming wire looped over, and substantially wrapping, the forming roll and the forming area;

a couch roll disposed within the second looped forming wire downstream of and above the forming roll for receiving the co-running forming wires onto its surface and such that the wires run in a generally upwardly vertical path from the forming roll to the couch roll;

a wire-guiding means disposed within the first looped forming wire and arranged to guide the first forming wire to form a converging throat in conjunction with the second forming wire over the forming area of the forming roll, the first and second forming wires substantially wrapping the forming roll downstream of the throat;

first and second stationary dewatering shoe means, with the first dewatering shoe means disposed within the first forming wire, and the second dewatering shoe means disposed within the second forming wire, both shoe means located downstream of the forming roll and upstream of the couch roll;

said first and second shoe menas defining, with the forming roll, a reversingly curved S-shaped path of travel of the co-traveling first and second forming wires in a formation zone extending from over the forming area to before the couch roll.

2. A two-wire web forming apparatus as set forth in claim 1, wherein:

deflector foil means is disposed within the second forming wire intermediate the couch roll and forming roll to receive water expressed therethrough.

3. A two-wire web forming apparatus as set forth in claim 1, wherein:

the second dewatering shoe means is disposed within the second forming wire downstream of the first dewatering shoe.

4. A two-wire web forming apparatus as set forth in claim 1, wherein:

one, or both, of the first and second dewatering shoe means include foil blade means for contacting the contiguous forming wire and defining a convexly curved surface toward the forming wire, and for urging water inwardly through the forming wire.

5. A two-wire web forming apparatus as set forth in claim 1, wherein:

one, or both, of the first and second dewatering shoes include a foraminous cover for contacting the contiguous forming wire and defining a convexly curved surface toward the forming wire, and for urging water inwardly through the forming wire.

6. A two-wire forming apparatus as set forth in claim 1, wherein:

the wire-guiding means disposed within the first looped forming wire comprises a stationary, curved, adjustably positionable surface whereby the converging throat can be circumferentially shifted relative to the forming area.

7. In an apparatus for forming a paper web from a stream of stock projected from a headbox nozzle, including a forming roll and a couch roll and first and second looped forming wires arranged to travel together in opposed array along a common path during a portion of their length between the forming roll and couch roll, the improvement comprising:

the couch roll is disposed within the second forming wire and located above the forming roll such that the wires run in a generally upwardly vertical path from the forming roll to the couch roll;

the forming roll is disposed within the second looped forming wire and includes an internal suction box and a forming area located over the suction box, the second forming wire substantially wrapping the forming roll and the forming area;

a wire-guiding means is disposed within the first looped forming wire and is arranged to guide the first forming wire to form a converging throat with the second forming wire over the forming area the first and second forming wires substantially wrapping the forming roll downstream of the throat;

a first dewatering shoe is disposed within the first forming wire downstream of the forming roll and has a convex, outwardly-curved surface facing toward the second forming wire and pressing the first and second forming wires together, said surface defined by a plurality of stationary dewatering element;

a second dewatering shoe is disposed within the second forming wire downstream of the first dewatering shoe, said second dewatering shoe having a convex, outwardly-curved surface facing toward the first forming wire and pressing the first and second forming wires together, said surface defined by a plurality of stationary dewatering element; and said first and second dewatering shoes defining, in conjunction with the forming area, a reversingly curved, S-shaped path of travel of the co-traveling first and second forming wires extending upwardly between the forming area on the forming roll and the couch roll.

8. A two-wire web forming apparatus as set forth in claim 7, wherein;

the first and second dewatering shoes include a plurality of transversely extending blades.

9. A two-wire web forming apparatus as set forth in claim 7, wherein:

the forming area over the forming roll subtends an angle about the longitudinal axis of the roll of up to about 100 degrees.

* * * * *